United States Patent [19]

Work et al.

[11] Patent Number: 4,769,632

[45] Date of Patent: Sep. 6, 1988

[54] COLOR GRAPHICS CONTROL SYSTEM

[75] Inventors: Gordon S. Work; Gerald R. Talbot, both of Bristol, England

[73] Assignee: INMOS Limited, Bristol, England

[21] Appl. No.: 828,208

[22] Filed: Feb. 10, 1986

[51] Int. Cl.[4] ..... G09G 1/28

[52] U.S. Cl. ..... 340/701; 340/703; 340/704; 340/799

[58] Field of Search ..... 340/701, 703, 704, 798, 340/799, 802

[56] References Cited

U.S. PATENT DOCUMENTS

| | | | |
|---|---|---|---|
| 4,361,850 | 11/1982 | Nishimura | 340/701 |
| 4,364,037 | 12/1982 | Walker | 340/703 |
| 4,454,593 | 6/1984 | Fleming et al. | 340/703 |
| 4,484,187 | 11/1984 | Brown et al. | 340/703 |
| 4,590,463 | 5/1986 | Smollin | 340/703 |
| 4,628,467 | 12/1986 | Nishi et al. | 340/703 |
| 4,684,942 | 9/1987 | Nishi et al. | 340/701 |

*Primary Examiner*—Gerald L. Brigance
*Assistant Examiner*—Jeffery A. Brier
*Attorney, Agent, or Firm*—Edward D. Manzo

[57] ABSTRACT

A color graphics control system for generating red, blue and green analog signals to a raster scan display at a pixel frequency comprises a RAM storing a pluraltiy of digital color values, digital to analog converters for converting the digital color values into analog signals, an interface to permit an external controller to write digital color values into the RAM locations, a timer including a pixel clock and RAM accessing means controlled by the timer to pipeline RAM accessing with a cycle time of more than one pixel period.

21 Claims, 6 Drawing Sheets

RED ANALOG OUTPUT
BLUE ANALOG OUTPUT
GREEN ANALOG OUTPUT
15
16
17
66
67
68
69
70
71
65
63
27
64
28
26
62
1 UNIT CURRENT
2 UNITS CURRENT
4 UNITS CURRENT
8 UNITS CURRENT
16 UNITS CURRENT
16 UNITS CURRENT
16 UNITS CURRENT
SWITCH 0
SWITCH 1
SWITCH 2
SWITCH 3
SWITCH 4
SWITCH 5
SWITCH 6
UNIT CURRENT SOURCES 0–63
SWITCHES 0–6
UNIT CURRENT SOURCES 0–63
SWITCHES 0–6
SYSTEM CLOCK
49
72
73
74
75
76
77
78
59
60
61
54
55
56
DECODER
DECODER
DECODER
SYSTEM CLOCK
48
30
BUS

COLOR GRAPHICS CONTROL SYSTEM

The invention relates to a color graphics control system for generating electrical signal values for respective color inputs to a raster scan color display unit under the control of a microprocessor screen controller or computer.

BACKGROUND OF THE INVENTION

Commonly computers or microcomputers are required to control a colon display on a raster scan color display unit such as a color cathode ray tube. In such a raster scan display unit each scanning line comprises a succession of pixels and it is necessary to supply analog input signals to the red, blue and green color inputs of the cathode ray tube at the pixel frequency in order to establish the correct color composition for each pixel. The color composition required for each pixel may be indicated by a numerical value stored in a pixel memory or bit map. Values from this pixel memory are read at the pixel frequency and must then be converted into appropriate analog signal values to each of the different color inputs for the cathode ray tube. Color look-up tables are known for this purpose. In this case a combination of red, blue and green color values is derived from a look-up table for each pixel value. Due to the high pixel frequencies normally used in a raster scan display problems arise in deriving red, blue and green color values from a color look-up table embodied in an integrated circuit memory device. Previous devices capable of operating at high pixel frequencies have involved many separate components at relatively high cost and with substantial power comsumption.

It is therefore an object of the present invention to provide a color graphics control system in which stored pixel values may be used to generate a succession of electrical signals representing respective color inputs for a raster scan color display unit at high pixel frequencies with low cost and low power consumption.

It is a further object of the invention to provide an improved color graphics control system which may be incorporated in a single integrated circuit chip.

SUMMARY OF THE INVENTION

The invention provides a color graphics control system for generating electrical signal values for respective color inputs to a raster scan color display unit in response to a succession of pixel values derived from a pixel memory device storing pixel values for a scanning sequence.

The control system includes a memory circuit, preferably a random access memory, having a plurality of addressable locations for storing digital color value data. A digital to analog converter circuit is coupled to the memory and receives digital color value data therefrom. In response, it generates a combination of analog signals representing red, blue and green color values for each pixel in the display. A timing circuit indicates a pixel frequency corresponding to the raster scan rate. It generates timing control signals for synchronizing the generation of the analog signals at the pixel frequency. The pixel data is applied to the memory circuit as a succession of pixel values from the pixel memory device at the pixel frequency, and the control system addresses and reads color value data from the memory in a multistage operation. The timing circuit controls each stage of the accessing so that a pipeline effect is achieved with a cycle time of more than one pixel period for addressing the memory location and reading the color value data for each pixel value.

An interface is coupled to the memory so that a controlling microprocessor or other controller can write color value data into the memory circuit.

Preferably said timing means is arranged to control RAM accessing so that each accessing operation extends over two successive pixel periods.

Preferably each location of the RAM stores a multi bit data value having bit groups representing red, blue and green color values, and said digital to analog converter means comprises three digital to analog converters arranged to receive separately a respective bit group so that they operate in parallel to provide simultaneously red, blue and green analog signals.

Preferably said interface includes temporary store means for receiving data from a microprocessor or other controller for use in writing into said RAM and access means for controlling loading of data into said temporary store means, said access means being operable independently of the pixel frequency to permit asynchronous loading of data into said interface from a microprocessor or other controller.

Preferably said temporary store means includes means for holding a RAM address and means for holding a digital color value to be written into said RAM address.

In one embodiment means is provided for incrementing the RAM address in said temporary store means after each writing operation.

Preferably the timing means includes a pixel clock providing signals at the pixel frequency and said interface includes synchronising means arranged to receive timing signals from said timing means whereby a writing operation from the interface into said RAM is synchronised with the pixel clock.

Preferably the writing operating is a multi-stage operation having a cycle time of more than one pixel period, each stage being controlled by said timing means so that a pipeline effect is achieved in writing in synchronism with the pixel clock over more than one period of the pixel frequency.

Preferably each digital to analog converter includes a plurality of parallel current sources connected to a common reference voltage, switch means responsive to said digital color value to control the number of current sources switched to form an analog output, and means for stabilizing the current derived from each current source so that it is independent of the number of parallel current sources that are switched on or off and thereby reduce nonlinearity of the digital to analog conversion.

In one embodiment each current source comprises a first transistor with said reference voltage forming a gate voltage for the transistor, the stabilising means comprising differential amplifier circuit means responsive to current fluctuations through said first transistor and arranged to provide a compensating voltage to the gate of a further transistor in series with said first transistor.

In a preferred arrangement each digital to analog converter includes a plurality of current sources together with switch means responsive to said digital color value to control the number of current sources operable in response to a digital color value, said current sources forming a plurality of groups of different numbers of current sources, all the current sources in each group being arranged to be switched on or off together by a single binary coded signal.

Preferably the digital to analog converter means includes means for receiving a multi-bit binary encoded signal representing a digital color value for conversion to an analog signal, and a plurality of selectively operable current sources with switch means for operating a selected number of current sources corresponding to the value of said multi-bit signal, said current sources being grouped into a plurality of groups wherein all current sources in a group are switched together, the groups having numbers of current sources corresponding to bits of different significance in said multi-bit signal with the largest group having a number of current sources representing less than the bit of maximum significance in said multi-bit signal, decoding means being provided for decoding said multi-bit signal and providing a number of switch actuating signals greater than the number of bits in said multi-bit signal, each switch actuating signal being provided for a respective group of current sources, thereby reducing the magnitude of any group of current sources necessary to be switched at any time.

Preferably the groups of current sources include a first group including progressively increasing numbers of current sources each corresponding to the numerical value of successive bit locations in said multi-bit signal and a second group at least one of which includes the maximum number of current sources to be switched as a single group, the second group being combined to represent the bit of maximum significance in the multi-bit signal.

Preferably said RAM, interface and digital to analog converter means are formed on a single integrated circuit device.

In one embodiment each addressable location in said RAM is arranged to store an 18-bit word, said word having three groups of six bits representing respectively the color values for red, blue and green.

A satisfactory color palette is provided when said RAM provides 256 addressable word locations.

The invention also provides a color graphics control system for generating electrical signal values for respective color inputs to a raster scan color display unit in response to a succession of pixel values derived from a pixel memory device storing pixel values for a scanning sequence.

DESCRIPTION OF THE PREFERRED EMBODIMENT

Figure 1:
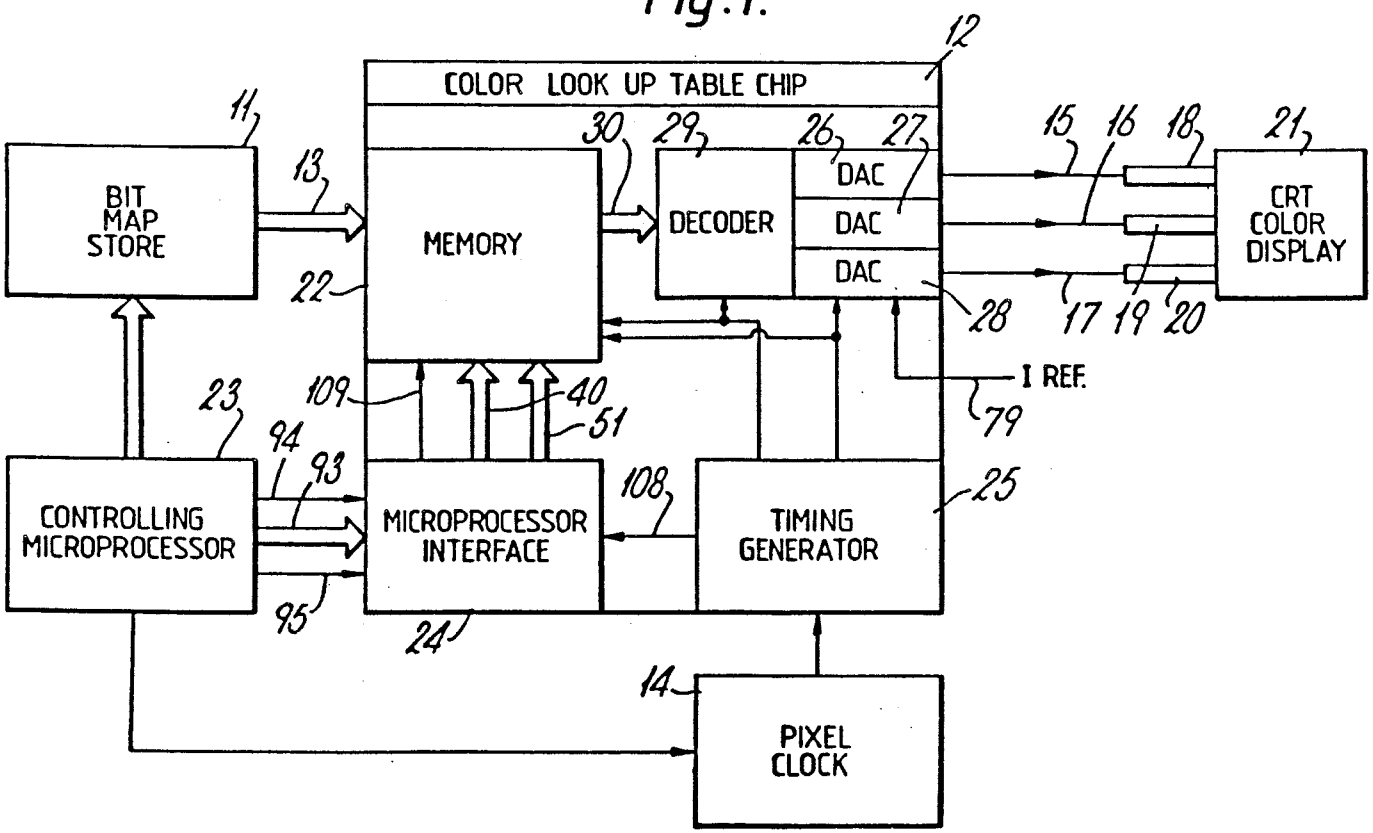
FIG. 1 is a block diagram of a color graphics control system in accordance with the present invention.

This example provides a color graphics control system for generating electrical signal values for respective color inputs to a raster scan display unit in response to a succession of pixel values derived from a pixel memory device in the form of a bit map store 11 storing pixel values for a scanning sequence. The color graphics control system includes a color look-up table chip 12 which is arranged to receive pixel values on a bus 13 from the store 11 at a pixel frequency determined by a pixel clock 14. The chip 12 converts the pixel values into analog electrical signals on output lines 15, 16 and 17 which are connected respectively to the red, blue and green guns 18, 19 and 20 of a color cathode ray tube 21. The chip 12 has a RAM memory 22 which is used to look up a color value for each of the pixel values received from the store 11 and a controlling microprocessor 23 is provided to allow control of the color values stored in the memory 22 for each of the possible pixel values.

In this example the chip 12 comprises a single integrated circuit device produced on a twin tub P-well in an N-substrate CMOS process with a composite silicide/doped polycrystalline transistor gate and interconnect material. The single integrated circuit chip includes in addition to the RAM 22, a microprocessor interface 24, a timing generator 25 and three digital to analog converters 26, 27 and 28 with decoding means 29.

The RAM 22 has 256 addressable locations each holding an 18 bit word representing a color value. Pixel values are supplied on the bus 13 at the pixel frequency determined by the pixel clock 14. Each pixel value is an 8 bit pixel word which is used as an address into the 256 location RAM 22. Each pixel value causes an 18 bit wide data value to be supplied on a bus 30 from the memory 22 to the decoder 29. The 18 bit data value is composed of three groups of 6 bits each representing an intensity value for red, blue or green respectively and is fed to the corresponding digital to analog converter 26 to 28. Thus, the 18 bits of a data value can indicate any of 262,144 combinations of color intensity values of red, blue and green. In this way, each pixel value can choose any one of 256 color values which are held in the memory 22. The timing generator 25 controls the timing operation of the memory 22, decoder 29 and digital to analog converters so that the analog output signals are supplied on lines 15, 16 and 17 at the same pixel frequency. The microprocessor 23 can write different color values into one or more memory locations 22 by use of the interface 24. In this way, the 256 locations in the memory 22 can be used to form a color palette which by use of the microprocessor 23 and interface 24 can select 256 different combinations, each such combination being one of 262,144 different colors.

In some application it is necessary to operate with a high pixel frequency and frequencies of up to 50 MHz may be required. This involves carrying out look up operations at time intervals of 20 ns. In this example a fast cycle time is achieved by using a pipelined RAM access so that address decoding for the RAM and reading of data from the memory cells in the RAM is completed as a multi-stage operation over two pixel clock cycles. This will be further described with reference to FIG. 2. The microprocessor interface 24 simplifies communication between the chip 12 and the microprocessor 23 and is totally asynchronous to the pipeline pixel clock.

Figure 2:
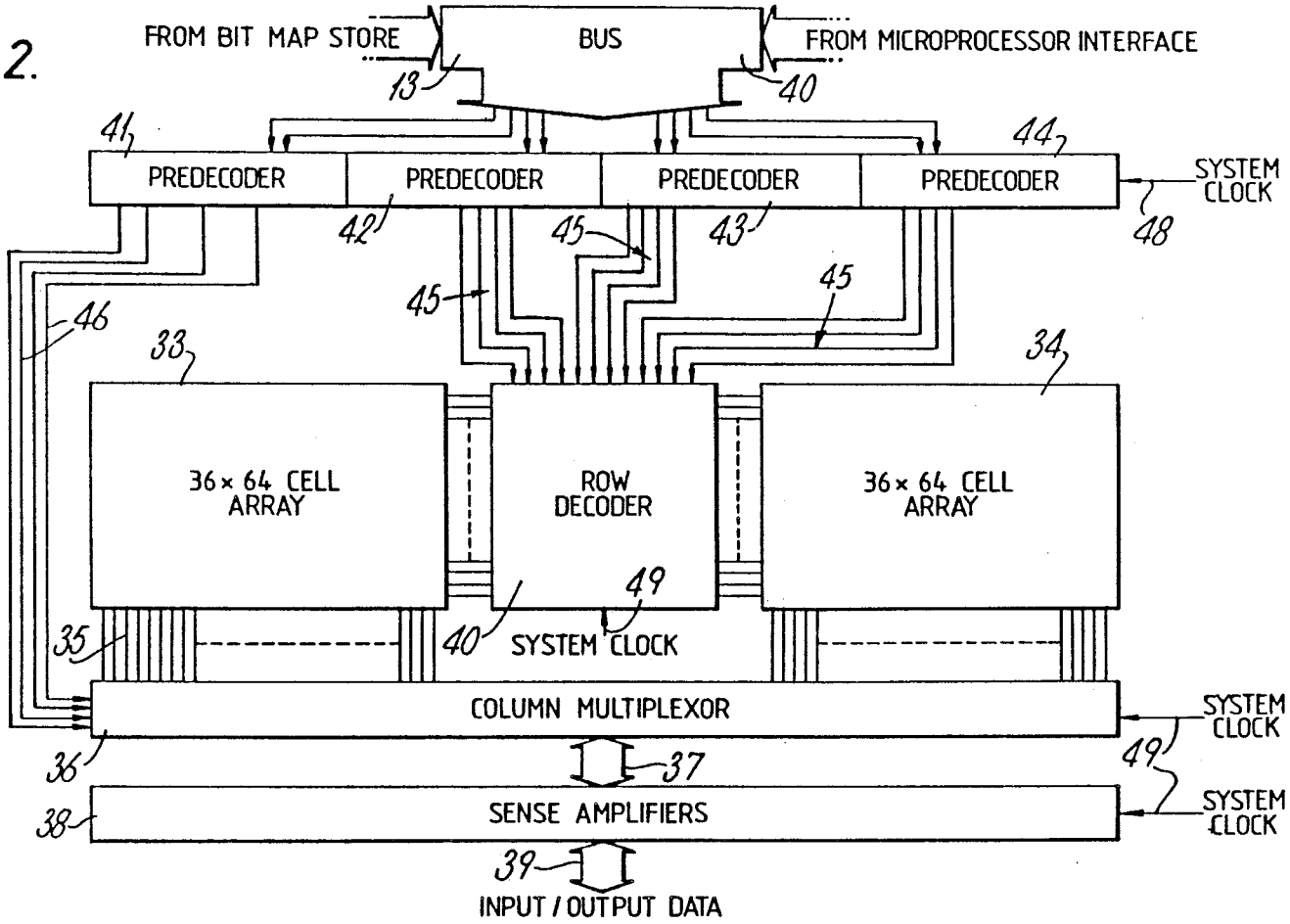
FIG. 2 is a more detailed block diagram of the memory shown in FIG. 1.

The RAM 22 and memory accessing procedure will be further described with reference to FIG. 2. The RAM is a static RAM having two arrays of memory cells each consisting of 36 columns and 64 rows. The arrays are marked 33 and 34. Each column is connected by a pair of bit lines 35 to a column multiplexor 36. The column multiplexor is connected by a two-way bus 37 to sense amplifiers 38 having a two-way bus 39 for the input and output of data. Each row is connected to a row decoder 40. Bus 13 supplying pixel values from the store 11 is also connected to a bus 40 connected to the microprocessor interface 24 for providing 8 bit write address values. The buses 13 and 40 provide an 8 bit signal which is split to supply two bits to each of four predecoders 41, 42, 43 and 44. Three predecoders decode the two bits received so that they each provide signals on four output lines 45 to the row decoder 40. One predecoder 41 provides signals on four lines 46 to the column multiplexor 36. The row decoder 40 therefore receives signals on 12 lines 45 and decodes these signals to select one of the 64 row lines. The column multiplexor effects a column select in response to the signals on the four lines 46. The columns are arranged into groups of four, and the signals on four lines 46 select which column in each group of four is be accessed so that 18 bits are accessed for each addressing operation. The sense amplifiers 38 determine the storage state of the accessed memory cells in the memory array in response to a pixel value on bus 13 or alternatively allow writing of data from the microprocessor interface 24 in response to an address from the microprocessor interface on bus 40.

Figure 6:
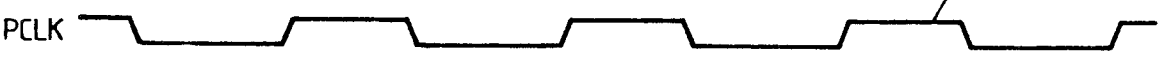
FIG. 6 illustrates a pixel frequency pulse train.
Figure 7:
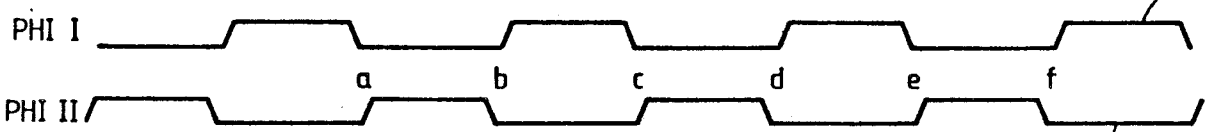
FIG. 7 illustrates two timing signals derived from the pixel frequency for use in the arrangement of FIG. 1.

The RAM accessing is carried out in a time controlled sequence under the control of the timing generator 25. The pixel frequency required for the raster scan in the CRT tube 21 is indicated by the pixel clock 14 which supplies to the timing generator 25 a pulse train indicated in FIG. 6. The timing generator 25 provides necessary systems clock pulses and these are indicated in FIG. 7 wherein the upper pulse sequence is denoted PHI I and the lower pulse sequence by PHI II. The clock pulses PHI I and PHI II marked 48 and 49 respectively form two-phase non-overlapping clocks generated by using an internal edge triggered monostable circuit via a two-phase clock generator to vary the monostable pulse width. In this way the clock signals 48 and 49 are determined by the rising edge of each pulse in the pixel clock train 50 but are not dependent on the duration of each pulse in the pixel clock train. These system clock pulses are supplied to the memory array as illustrated in FIG. 2. The memory accessing operation is the multi-stage operation extending over two pixel pulses and with reference to the letters marked in FIG. 7, the address is latched into the predecode circuitry 41 to 44 at the point marked (a) where signal PHI I goes to a low value and the predecode is carried out. When signal PHI II goes low at the point marked (b) the predecoded row lines are latched and the row decode is performed as well as the column select. When signal PHI I goes to a low value again at the point marked (c) the accessed row is latched and the word lines in the memory array are driven. When signal PHI II goes low again at the point marked (d) the sense amplifiers 49 sense the signal values on the bit lines 35 and drive data out through the bus 39. It will therefore be seen that the RAM accessing is carried out as a pipelined operation in which successive stages are carried out in a pipeline extending over two pixel periods.

The bus 39 leading from the sense amplifiers 38 is connected to both buses 30 leading to the decoder 29 and a further data bus 51 from the microprocessor interface 24. The bus 30 supplies in parallel 18 bits from the RAM 22 representing the color intensity value corresponding to the pixel value from the bit map store 11. The digital to analog conversion will be described in more detail with reference to FIG. 4. As illustrated, the 18 parallel bits from the bus 30 consist of 6 bits representing a red signal which are fed to a first decoder 54, a further six bits representing the blue signal which are fed to a second decoder 55 and the remaining six bits representing the green value are fed to a third decoder 56. The three decoder units 54, 55 and 56 illustrated in FIG. 4 form the decoder unit 29 illustrated in FIG. 1. Each decoder 54, 55, 56 decodes the incoming signal to produce outputs on a corresponding group 59, 60 and of lines, each such group comprising seven binary signal lines leading to respective digital to analog converters 62, 63 and 64. Each of the digital to analog converters is similar and only unit 62 handling the red signal will be described in detail. The DAC 62 consists of a plurality of current sources which may be selectively switched to generate an analog voltage corresponding to the digital input. The current sources each provide a standard unit of current. The current sources are however grouped into a variety of different size groups, all current sources within any one group being switched as a unit. The first group 65 has only a single current source providing one unit of current when switched on. Group 66 provides two units of current. Similarly group 67 has four current sources and provides four units of current, group 68 has eight current sources and provides eight units of current, and group 69 has sixteen current sources providing sixteen units of current. Groups 70 and 71 each contain a further sixteen current sources and each provide sixteen units of current. Each group of current sources has an associated switch control connected to a respective one of the seven output lines 59 from the decoder 54. The swich controls have been marked 72 to 77 respectively and it can be seen that switch 72 corresponds to the bit of least significance in the output of the decoder 54 and switch 77 corresponds to the output line of greatest significance. It will therefore be seen that the groups of current sources 65, 66, 67, 68 and 69 have progressively increasing current values corresponding to the digital value on the output lines 59 controlling their switches. However, groups 70 and 71 do not follow this pattern in that they repeat sixteen current sources which is less than the digital value of the most significant bit in the output of decoder 54. This is in order to limit the maximum number of current sources which may be switched at any time in order to change the analog output to represent a change in digital input. This will be further described after reference to FIG. 5.

Figure 4:
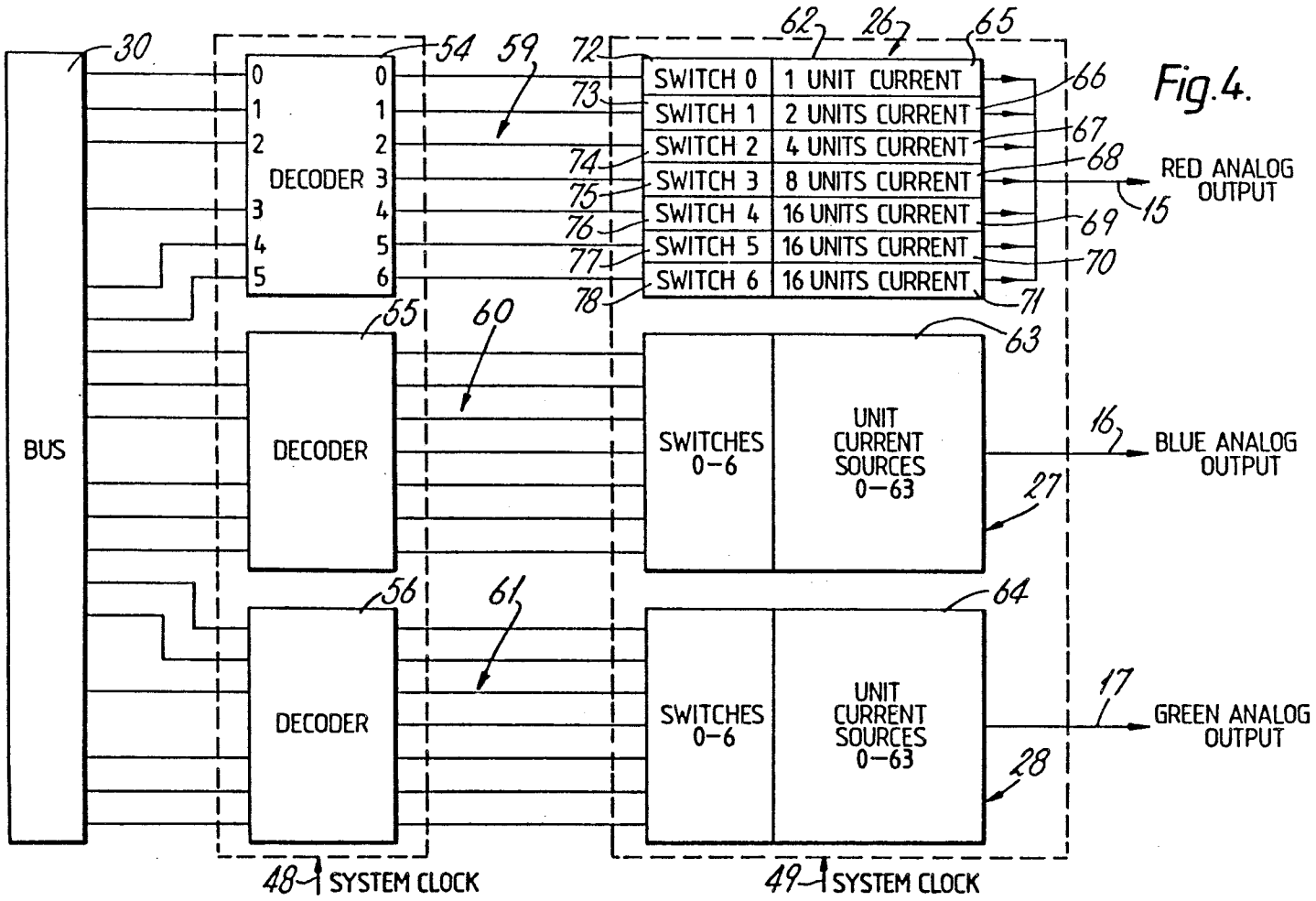
FIG. 4 is a more detailed diagram of the digital to analog converters of FIG. 1.
Figure 5:
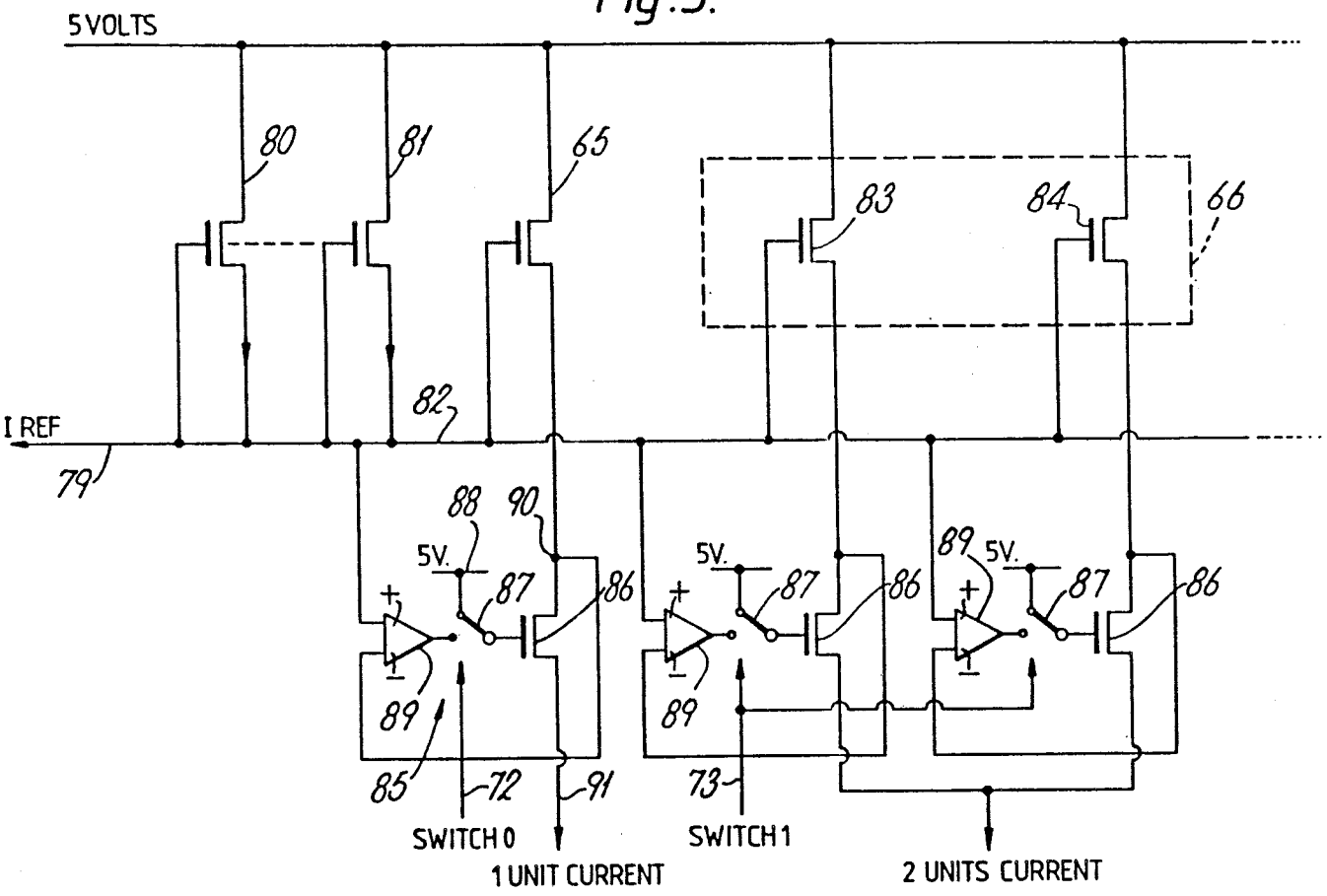
FIG. 5 shows a group of current sources used in the digital to analog converters of FIG. 4.

FIG. 5 illustrates further details of some current sources used in the digital to analog converter of FIG. 4. A specified reference current IREF is supplied on line 79 from an external source. This is applied to the gate of a plurality of parallel transistors 80 to 81 arranged to provide a suitable reference voltage on line 82. This reference voltage is then applied to the gate of a transistor 65 forming the first current source. Further current sources such as transistors 83 and 84 forming the second current source 66 are connected in parallel, and each has its gate connected to the reference voltage 82. It will be appreciated that further transistors similar to those marked 83 and 84 are also connected in similar fashion and grouped together to form the other groups of current sources described with reference to FIG. 4. In order to provide high quality colon displays, it is important to provide linear digital to analog conversion, and due to the finite conductance of the transistors used as the current sources, stabilizing circuitry 85 is provided for each current source. This consists of a further transistor 86 connected in series with the transistor 65. Its gate is connected to a transistor switch 87 under control of the switch signal 72. This may connect the gate of transistor 86 to a five volt supply line 88 when the current source is switched off or alternatively to the output of a differential operational amplifier 89 when the current source is switched on. The differential amplifier 89 has one input connected to the reference voltage line 82 and the other input connected to a point intermediate the transistors 65 and 86. In the event of further current sources being switched on or off in such a manner as to vary the potential at the junction 90, the differential amplifier 89 varies the gate potential on transistor 86 so as to restore the potential at junction 90 to the required value. In this way the single unit of current which is output on line 91 from the current source 65 is stabilized and substantially independent of the number of current sources which are switched on. Each of the subsequent current sources such as transistors 83 and 84 has a similar stabilizing circuit 85 but in this case the switches 87 are linked together so that they are switched together in dependence on the switch signal on line 73.

When there are changes in the digital signals supplied to the digital to analog converters, unwanted spikes representing glitch energy may occur in the analog outputs. This can result from irregular loading on the data inputs to the digital to analog converter causing data skews, and it may also be caused by asymetrical turn-on and off characteristics of the transistors forming the current sources. The above described arrangement reduces unwanted glitch phenomenon by arranging for the decoding by units 54, 55 and 56 as well as the limited size of current source groups in the digital to analog converters. In the arrangement shown in FIG. 4, the decoding is time controlled in response to the waveform PHI I in FIG. 7. Decoded outputs are supplied on lines 59, 60 and 61 in response to a fall in value in waveform 48 as indicated at point (e) in FIG. 7.

The operation of the current sources within the digital to analog converters is however controlled by signal PHI II so that the analog outputs are generated when signal PHI II falls to a lower level as indicated at point (f) in FIG. 7. It will therefore be seen that the digital to analog conversion extends the pipeline operation commenced at memory accessing so that the entire pipeline operation of accessing the memory and producing analog output signals is a pipeline operation carried out in synchronism with the pixel frequency with the pipeline period extending over three pixel periods. By carrying out the decoding prior to supplying signals on lines 59, 60 and 61 to the digital to analog converters, the data input to the switches of the digital to analog converters is realigned in relation to the systems clock on application to the input of every current source. Furthermore, any glitch phenomenon due to asymmetrical switch on and off characteristics of the transistors is reduced by avoiding the necessity to switch any single group of current sources corresponding to the bit of greatest significance which in this example would be 32. In the example shown in FIG. 4, the decoder 54 has output lines marked 0 to 6. An output on line 0 activates one current source. An output on line 1 activates two current sources. An output on line 2 activates four current sources. An output on line 3 activates eight current sources. An output on line 4 activates sixteen current sources and is caused by the logical OR of an input on either lines 4 or 5 of the decoder 54. An output on line 5 is caused by an input on line 5 and activates sixteen current sources. An output on line 6 is generated by the logical AND of inputs on lines 4 or 5 of the decoder 54 and activates sixteen current sources. In this way it is possible to select analog values representing any of 64 different digital inputs without switching a single block of current units greater than 16 so that any asymmetric transistor characteristics have a reduced effect in producing glitch phenomenon.

Although the RAM 22 holds data for 256 color at any one time, these can be varied by writing in different color values from the microprocessor 23 through the interface 24. The microprocessor may communicate with the interface (FIG. 3) at a much slower speed than the pixel frequency and this example enables the microprocessor to load data into the interface asynchronously with the pixel frequency. The microprocessor is connected to the interface by a data bus 93 leading to a data buffer 96. It is also connected by a register select line 94 and a WRITE control line 95. The WRITE control line 95 is connected to a WRITE buffer 97 which controls the periods in which the microprocessor is permitted to write data into the interface. The WRITE buffer 97 supplies a signal to a register select decoder 98 which is controlled by the register select line 94 to select whether data fed into the data buffer 96 from the microprocessor 23 is supplied to an address register 99 or a data register 100. When it is required to write new color values into the RAM 22, the address register 99 is loaded with the first address in the RAM 22 into which a new color value is to be written. The new color value is then supplied through the data buffer 96 into the data register 100. Three successive bytes are supplied so as to fill the three registers 100, 101 and 102. The least significant six bits of each byte in the registers 100, 101 and 102 are fed into an 18 bit buffer 103. This 18 bit word consists of three groups of six bits representing the red, blue and green color values. When the byte counters 104, 105 and 106 indicate that three bytes have been loaded, a signal is fed to a synchronizer 107 which also receives a system clock signal 108 from the timing generator 25. The synchronizer provides a WRITE signal on line 109 to the sense amplifiers 38 and the WRITE address is supplied from the address register 99 on the bus 40 so that at the beginning of the next synchronous pixel controlled pipeline, a writing operation is carried out at the address indicated by the contents of the register 99. The data written into the RAM 22 is supplied from the buffer 103 on the data bus 110 which is connected to the input data bus 39 connected to the sense amplifiers 38. The synchronizer 107 has one signal line 111 to control the supply of address data from the register 99 onto the bus 40. It has a further line 112 which may be used to increment the address after each writing operation.

Figure 3:
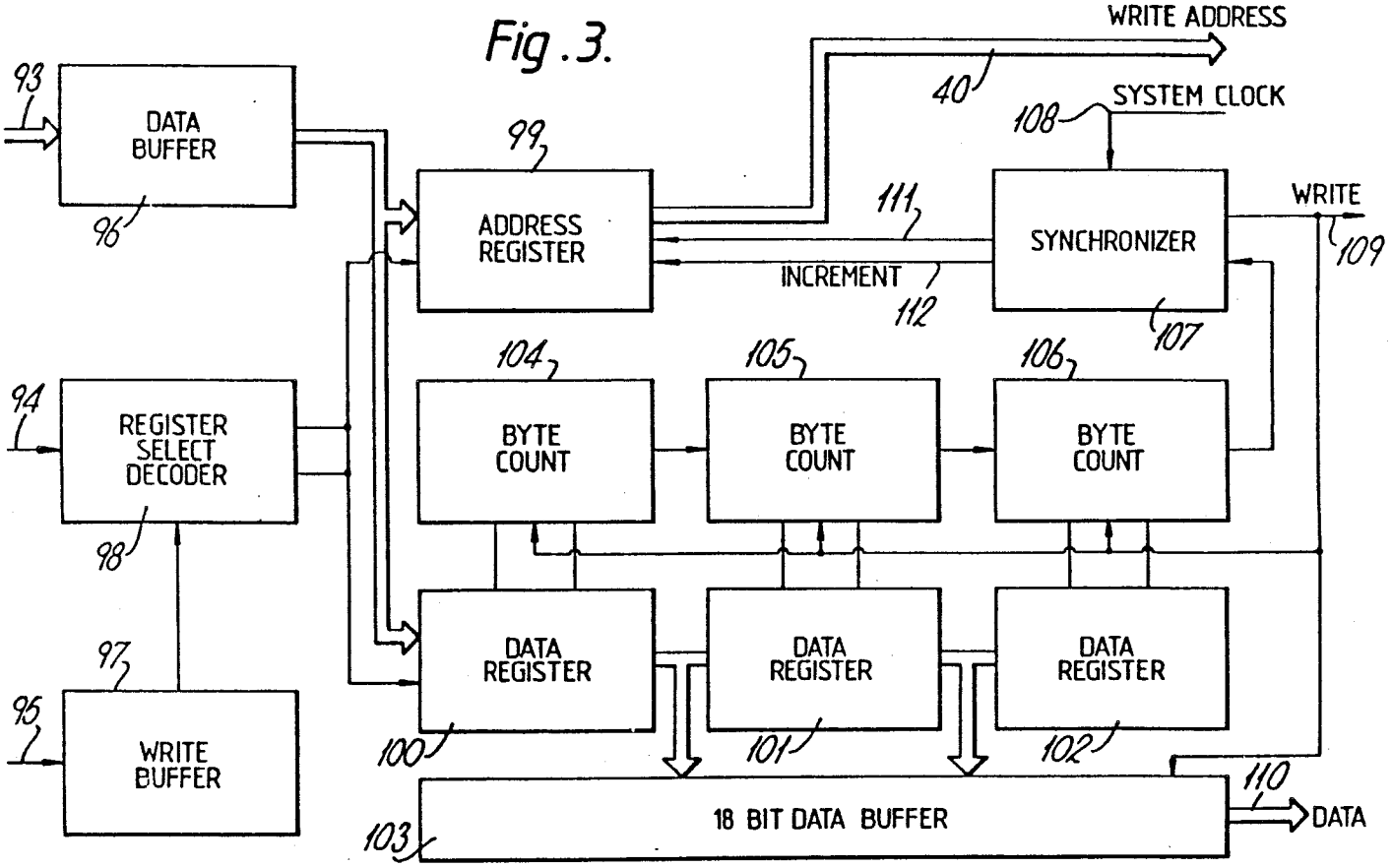
FIG. 3 is a more detailed block diagram of the microprocessor interface shown in FIG. 1.

By use of the interface shown in FIG. 3, the microprocessor may communicate with the interface asychronously without reference to the pixel clock signal, but the synchronizer 107 arranges for the writing operation from the interface to be carried out in synchronism with the pixel clock controlled pipeline operation.

By use of the pipelining operation, the required analog signals are supplied to the input of the cathode ray tube at the required pixel frequency although the generation of the analog signal from the original pixel value in the bit map store 11 has extended over three whole pixel periods. The delay between the store 11 and the input to the cathode ray tube 21 is not important provided new values are supplied at the required pixel frequency. This enables the use of a color look-up table chip 12 of simplified form and does not require a memory which is capable of being accessed in a single operation within one pixel period. The above embodiment also has a low power consumption in that it may dissipate less than 600 mW.

The invention is not limited to the details of the foregoing example.

We claim:

1. A color graphics control system for generating electrical signal values for respective color inputs to a raster scan color display unit in response to a succession of pixel values derived from a pixel memory device storing pixel values for a scanning sequence, said control system comprising:

a RAM having a memory array having a plurality of addressable locations each storing digital color value data;

a digital to analog converter circuit coupled to receive digital color value data from said RAM, said converter circuit being responsive to each color value data to generate a corresponding combination of analog electrical signals representing respectively red, blue and green color values for each pixel in a raster scan display;

a timing circuit for indicating a pixel frequency corresponding to that of the raster scan and for generating timing control signals for synchronizing the generation of said analog signals at said pixel frequency;

said RAM including receiving means and decoding circuitry coupled to receive a succession of pixel values from the pixel memory device at the pixel frequency, said receiving means and decoding circuitry being responsively coupled to said timing circuit for causing a multistage accessing operation including addressing and reading from a corresponding location of said memory array a digital color value for supplying to said digital to analog converter circuit; and an interface coupled to said RAM for connection to a microprocessor or other controller to permit the microprocessor or other controller to write different digital color values into one or more locations in said memory array;

said timing circuit being coupled to said receiving means and decoding circuitry so that a pipeline effect is achieved with a cycle time of more than one pixel period for addressing a memory array location and reading the digital color value for each pixel value.

2. A color graphics control system according to claim 1 wherein said timing circuit is coupled to control said decoding circuitry so that each accessing operation extends over two successive pixel periods.

3. A color graphics control system according to claim 1 wherein each location of said memory array stores a multi-bit data value having bit groups representing red, blue and green color values, and said digital to analog converter circuit comprises three digital to analog converters coupled to receive separately a respective bit group so that they operate in parallel to provide simultaneously red, blue and green analog signals.

4. A color graphics control system according to claim 1 in which said interface includes temporary store means coupled for receiving data from a microprocessor or other controller for use in writing into said RAM and access means for controlling the loading of data into said temporary store means, said access means being operable independently of pixel clock timing to permit asynchronous loading of data into said interface.

5. A color graphics control system according to claim 4 in which said temporary store means includes means for holding a RAM address and means for holding a digital color value to be written into said RAM address.

6. A color graphics control system according to claim 5 further including means for incrementing the RAM address in said temporary store means after each writing operation.

7. A color graphics control system according to claim 4 in which said timing circuit includes a pixel clock providing signals at the pixel frequency and said interface includes synchronizing means arranged to receive timing signals from said timing circuit so that a writing operation from the interface into said RAM is synchronized with the pixel clock.

8. A color graphics control system according to claim 7 in which said writing operation is a multi-stage operation having a cycle time of more than one pixel period, each stage of said multi-stage operation being controlled by said timing circuit so that a pipeline effect is achieved in writing in synchronism with the pixel clock over more than one period of the pixel frequency.

9. A color graphics control system according to claim 3 wherein each of said digital to analog converters includes a plurality of parallel current sources coupled to a common reference voltage, switch means responsive to said digital color value to control the number of current sources switched to form an analog output, and means for stabilizing the current derived from each current source so that it is independent of the number of parallel current sources that are switched on or off and thereby reduce non-linearity of the digital to analog conversion.

10. A color graphics control system according to claim 9 in which each current source comprises a first transistor with said reference voltage forming a gate voltage for the transistor, the means for stabilizing comprising differential amplifier circuit means responsive to current fluctuations through said first transistor and arranged to provide a compensating voltage to the gate of a further transistor in series with said first transistor.

11. A color graphics control system according to claim 3 in which each digital to analog converter includes a plurality of current sources together with switch means responsive to said digital color value to control the number of current sources operable in response to a digital color value, said current sources forming a plurality of groups of different numbers of current sources, all the current sources in each group being coupled to be switched on or off together by a single binary coded signal.

12. A color graphics control system according to claim 1 wherein said digital to analog converter circuit includes means for receiving a said color value data, said color value data comprising a multi-bit binary encoded signal representing a digital color value for conversion to an analog signal, said digital to analog converter circuit further comprising a plurality of selectively operable current sources with switch means for operating a selected number of current sources corresponding to the value of said multi-bit signal, said current sources being grouped into a plurality of groups wherein all current sources in a group are switched together, the groups having numbers of current sources corresponding to bits of different significance in said multi-bit signal with the largest group having a number of current sources representing less than the bit of maximum significance in said multi-bit signal, decoding means being provided for decoding said multi-bit signal and providing a number of switch actuating signals greater than the number of bits in said multi-bit signal, each switch actuating signal being provided for a respective group of current sources, thereby reducing the magnitude of any group of current sources necessary to be switched at any time.

13. A color graphics control system according to claim 12 wherein the groups of current sources include a first group including progressively increasing numbers of current sources each corresponding to the numerical value of successive bit locations in said multi-bit signal and a second group at least one of which includes the maximum number of current sources to be switched as a single group, the second group being combined to represent the bit of maximum significance in the multi-bit signal.

14. A color graphics control system according to claim 1 wherein said RAM, interface and digital to analog converter circuit are formed on a single integrated circuit device.

15. A color graphics control system according to claim 14 wherein each addressable location in said memory array is arranged to store an 18-bit word, said word having three groups of six bits representing respectively the color values for red, blue and green.

16. A color graphics control system according to claim 15 wherein said RAM provides 256 addressable word locations.

17. A color graphics control system for generating electrical signal values for respective color inputs to a raster scan color display unit in response to a succession of pixel values derived from a pixel memory device storing pixel values for scanning sequence, said control system comprising:

a RAM having a plurality of addressable locations each storing a digital color value, digital to analog converters respectively for red, blue and green signals, each arranged to receive a multi-bit digital color value from said RAM and in response to each color value to generate a corresponding analog electrical signal for each pixel in a raster scan display, each said digital to analog converter including means for receiving a multi-bit binary encoded signal and a plurality of selectively operable current sources with switch means for operating a selected number of current sources corresponding to the value of said multi-bit signal, said current sources being grouped into a plurality of groups wherein all current sources in a group are switched together, the groups having numbers of current sources corresponding to bits of different significance in said multi-bit signal with the largest group having a number of current sources representing less than the bit of maximum significance in said multi-bit signal, decoding means being provided for decoding said multi-bit signal and providing a number of switch actuating signals greater than the number of bits in said multi-bit signal, each switch actuating signal being provided for a respective group of current sources, timing means for indicating a pixel frequency corresponding to that of the raster scan and generating timing control signals for synchronizing the generation of said analog signals at said pixel frequency, RAM accessing means for receiving a succession of pixel values from said pixel memory device at the pixel frequency and in response to each pixel value effecting a multi-stage accessing operation including addressing an corresponding location of the RAM and reading from the location a digital color value for supplying to said digital to analog converters, and an interface coupled to said RAM and arranged for connection to a microprocessor or other controller to permit the microprocessor or other controller to write different digital color values into one or more locations in said RAM, said timing means being coupled to control each stage of RAM accessing wherein a pipeline effect is achieved with a cycle time of more than one pixel period for addressing a RAM location and reading the digital color value for each pixel value.

18. A color graphics control method for generating electrical signals for respective color inputs to a color display comprising the steps of:

storing digital color value data in a memory circuit;

receiving a sequence of pixel values for a scanning sequence;

in response to said sequence of pixel values, accessing data in the memory circuit by addressing said memory circuit and reading therefrom respective color value data for each said pixel value, said accessing occurring in multiple stages;

providing timing signals from a pixel clock;

converting said color value data which have been read from said memory circuit into analog signals representing red, blue and green color values; and controlling said addressing, reading and converting in accordance with said timing signals to pipeline said operation so that a digital color value for each pixel value is obtained at the pixel clock frequency even though the cycle time of said accessing is more than one pixel period.

19. A color graphics control method according to claim 18 further comprising storing digital color value data in a RAM memory circuit, writing different digital color values into one or more locations in the RAM, said writing comprising loading data from a controller into a temporary store in an operation independent of pixel clock timing, and subsequently transferring data from the temporary store to the RAM in a transfer operation synchronized with pixel clock timing.

20. A color graphics control method according to claim 18 wherein color value data is converted into analog signals representing red, blue and green color values by generating a multi-bit binary encoded signal representing a digital color value for conversion to an analog signal, decoding said multi-bit signal to provide a number of switch actuating signals greater than the number of bits in said multi-bit signal, and using each of said switch actuating signals to switch simultaneously respective groups of current sources, the groups of current sources having number of current sources corresponding to bits of different significance in said multi-bit signal with the largest group providing a current representing less than the bit of maximum significance in said multi-bit signal.

21. A color graphics control method according to claim 19 wherein color value data is converted into analog signals representing red, blue and green color values by generating a multi-bit binary encoded signal representing a digital color value for conversion to an analog signal, decoding said multi-bit signal to provide a number of switch actuating signals greater than the number of bits in said multi-bit signal, and using each of said switch actuating signals to switch simultaneously respective groups of current sources, the groups of current sources having number of current sources corresponding to bits of different significance in said multi-bit signal with the largest group providing a current representing less than the bit of maximum significance in said multi-bit signal.

* * * * *